United States Patent [19]

Liepelt, deceased et al.

[11] Patent Number: 4,744,294

[45] **Date of Patent: * May 17, 1988**

[54] CYLINDER PRESS CONVERSION FOR HOT DIE APPLICATION OF FOIL

[76] Inventors: Dirk Liepelt, deceased, late of Cornelius; by Joan A. Liepelt, Personal Representative of the Estate, Rte. 1, Box 280, Cornelius, both of Oreg. 97113

[ * ] Notice: The portion of the term of this patent subsequent to Dec. 9, 2003 has been disclaimed.

[21] Appl. No.: 921,639

[22] Filed: Oct. 21, 1986

Related U.S. Application Data

[63] Continuation of Ser. No. 743,375, Jun. 11, 1985, Pat. No. 4,627,343.

[51] Int. Cl.[4] ..... B41F 3/18

[52] U.S. Cl. ..... 101/27; 101/281; 101/336; 400/232

[58] Field of Search ..... 101/27, 336, 281; 400/232, 224, 213, 223

[56] References Cited

U.S. PATENT DOCUMENTS 4,627,343 12/1986 Liepelt ..... 101/27

FOREIGN PATENT DOCUMENTS 2742974 3/1979 Fed. Rep. of Germany ..... 400/232

2065563 7/1981 United Kingdom ..... 400/232

*Primary Examiner*—Clifford D. Crowder

[57] ABSTRACT

Apparatus attached to the reciprocating chase of a cylinder press for carrying one or more supply spools of a web of foil-carrying material, together with an adjustable computerized controller and web-pulling rollers associated with the cylinder press and responsive to the controller, for holding a portion of the foil-carrying web suspended above the chase and moving the foil-carrying web a predetermined distance after each impression from the foil onto print stock. An articulated support rack extends from the chase to a structure supporting the web-pulling rollers, to maintain tension in the web as the chase moves. The controller is adjustable to pull a preselectable incremental length of the web a preselectable number of times and to pull a different preselectable length of the web automatically after each group of such selectable number of pulls each having that incremental length.

2 Claims, 4 Drawing Sheets

CYLINDER PRESS CONVERSION FOR HOT DIE APPLICATION OF FOIL

This application is a continuation of application Ser. No. 743,375, filed 6/11/85, now U.S. Pat. No. 4,627,343.

BACKGROUND AND SUMMARY OF THE INVENTION

The present invention relates to application of foil to paper, and particularly to conversion of a cylinder press for use in hot die stamping application of foil.

It is well known to apply a coat of material known as a "foil" by a hot die stamping process. Such foil material is provided as a layer of coating material carried, for example, on a supporting web of thin film plastic material. The "foil" coating is released by raising the temperature high enough to release an adhesive bond between the foil and the supporting web, while pressure is applied to cause the foil to adhere to the paper stock in a desired location and pattern.

U.S. Pat. No. 3,296,958 describes a heated plate for use in hot die stamping of foil onto paper and similar stock, and U.S. Pat. No. 3,316,835 describes apparatus for use in conjunction with a printing press of the platen type for carrying out the application of such foil. There are, however, several problems associated with use of cylinder press which are not solved by the platen press conversion apparatus described in U.S. Pat. No. 3,316,835.

A cylinder press includes a cylinder which rotates, carrying a sheet of paper stock on which an impression is to be made. A chase of such a press moves reciprocatingly in mechanical synchronization with rotation of the cylinder, to carry the type, in normal printing, or in the case of hot die foil stamping, to carry a heated die beneath the cylinder, so as to move the type or die at the same speed at which the paper is carried by the cylinder. Foil which is to be applied by such a cylinder press must be held in a position between the die and the paper stock, yet must not touch the heated die except when it is intended to make an impression of foil upon a piece of stock. The heat of the die would otherwise prematurely release contacted portions of the foil from the supporting web. It is thus necessary to support the foil-carrying web so that it is ordinarily kept from touching the hot die.

Because of the high cost of the foils which are used in this process, it is desirable to use the foil with as little waste as possible. It is thus desired to move a long and relatively narrow web of roll-foil material only the minimum distance necessary, after an impression is made on a sheet of stock, to assure that fresh foil is in position for application to the next sheet of stock. Where foil impressions are made in more than one location upon each sheet of stock, the foil-supporting web need be moved only a short distance to provide clear foil for each impression for a certain number of sheets of stock, after which it may be necessary to move the foil supply a larger distance in order to have foil again available for all of the separate impressions to be made upon a subsequent piece of stock.

The present invention supplies apparatus for supporting and moving webs of roll-foil material for hot die stamping using a cylinder press. A supply of foil-carrying web material is wound on a spool carried on an end of the chase of a cylinder press. The web of foil-carrying material extends material extends across the top of the chase above a heated die carried on the chase. The foil-carrying material is supported safely spaced above the surface of the hot die except during the time when it is intended to make a foil impression of the die upon a piece of stock.

A foil draw controller controls operation of a draw roller and a pinch roller which cooperatively move the web of foil-carrying material as needed to provide fresh foil for each subsequent impression. The foil draw controller is adjustable to control the distance the web of foil-carrying material is usually drawn after each impression, to count the number of times the foil is drawn this distance, and to control the draw roller drive thereafter to draw the foil a greater distance to provide fresh foil for a subsequent set of impressions.

The draw roller drive includes a motor and a relay-controlled clutch responsive to the draw controller. A rewind spooling mechanism is also provided to accumulate the remaining portions of the foil material.

An articulated foil support frame, or rack, connects the reciprocatingly moving chase with a fixed frame which supports the draw roller and pinch roller at one end of the cylinder press. The web of foil-carrying material extends around rollers on the articulated support frame so that the web of foil-carrying material is prevented from becoming slack between the supply spool and the draw roller, despite the motion of the chase.

It is therefore a principal object of the present invention to provide a conversion mechanism which can be attached to a cylinder press quickly and easily to enable such cylinder press to be used for foil stamping operations while utilizing, as far as possible, the operative mechanism of the cylinder press, so as to avoid the need for a special press for hot die stamping.

It is another object to utilize the automatic paper-handling mechanism of the cylinder press in the stamping operation and to provide a stamping press operation having operating characteristics as automatic as those of the cylinder press.

It is a further object of the present invention to provide apparatus for controlling the rate at which the web of foil-carrying material is moved across the chase, in accordance with the size of the stamping die so as to provide a fresh foil surface for each stamping operation, while conserving the foil-carrying material as much as possible.

It is an important feature of the present invention that the foil drawing mechanism and the foil draw control system are adjustable to pull an adjustable multiple of short draws, followed by a long draw, of foil from a supply roll of foil-carrying material, and to continue such a sequence during a foil-stamping run of many sheets of stock.

It is an important advantage of the present invention that it provides for increased economy of foil utilization.

It is another advantage of the present invention that it makes it unnecessary to provide a separate press for hot die foil stamping use.

The foregoing and other objectives, features and advantages of the present invention will be more readily understood upon consideration of the following detailed description of the invention taken in conjunction with the accompanying drawings.

DETAILED DESCRIPTION OF THE DRAWINGS

Figure 1:
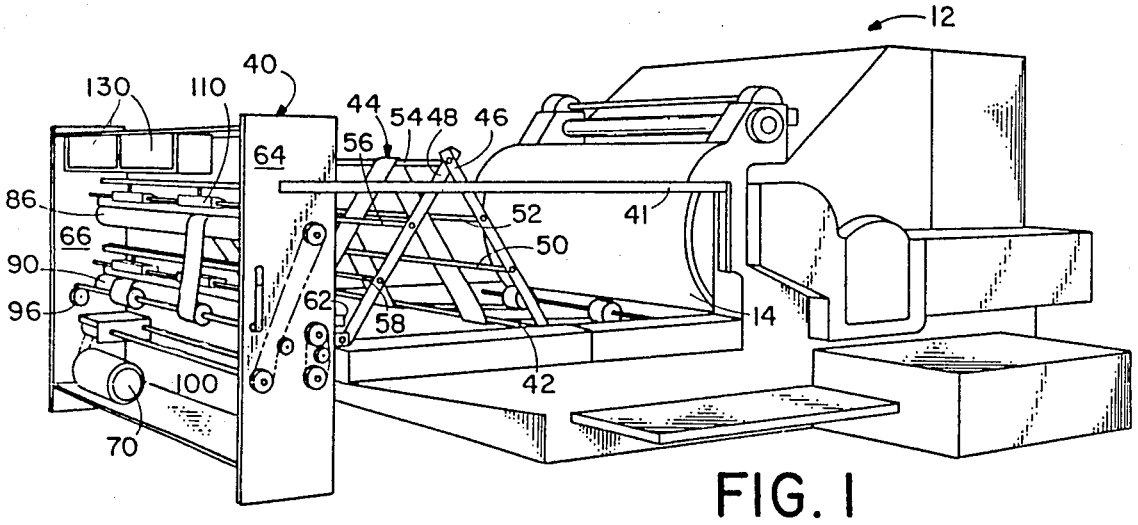
FIG. 1 is a view of a cylinder press, together with foil-carrying apparatus embodying the present invention which enables the cylinder press to be used for hot die application of foil.
Figure 3:
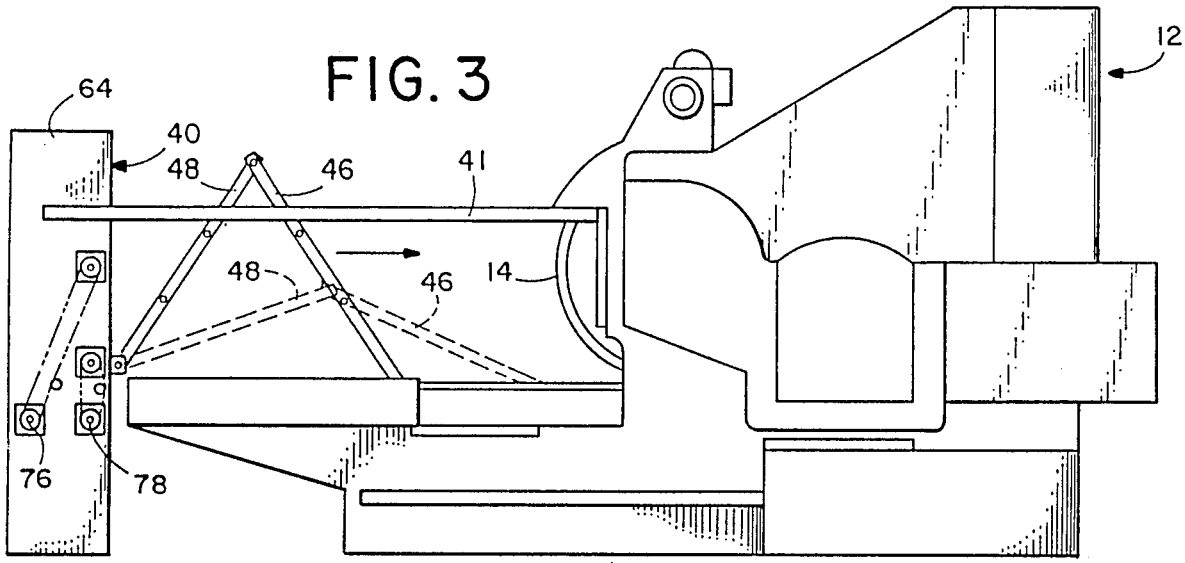
FIG. 3 is a side view of the cylinder press and the foil-carrying apparatus shown in FIG. 1.
Figure 2:
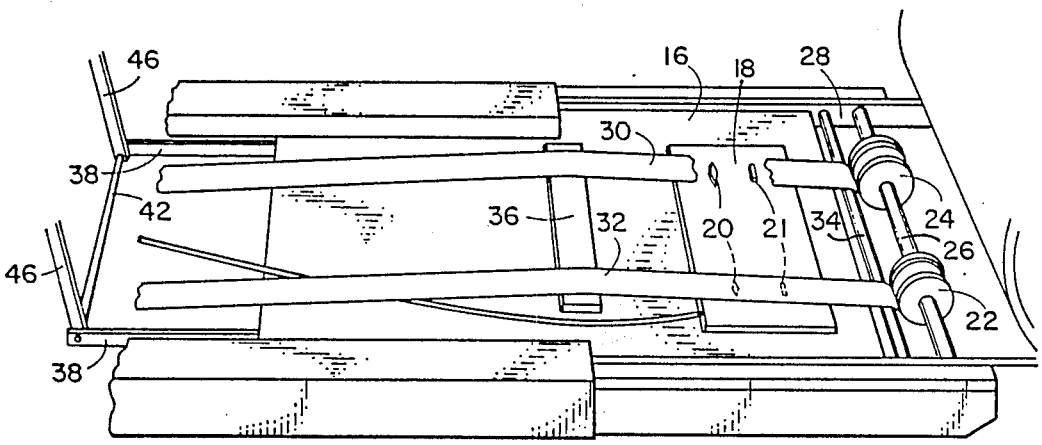
FIG. 2 is a perspective view showing the chase of the cylinder press and a portion of the foil-carrying apparatus shown in FIG. 1, at an enlarged scale.

Referring now to FIGS. 1-3, a cylinder press 12 has a cylinder 14 including well-known mechanisms (not shown) for accepting and holding sheets of stock paper and carrying each sheet individually as the cylinder 14 rotates. As the cylinder rotates a chase 16 moves reciprocatingly along a horizontal path extending beneath the cylinder 14, with its movement in one direction synchronized with movement of the surface of the cylinder 14. A heated plate 18 fixed to the chase 16 by conventional furniture carries stamping dies 20 and 21 beneath the cylinder 14 so as to cause the stamping dies 20 and 21 to exert pressure upward against the paper stock carried by the cylinder 14. As the chase 16 is synchronized with rotation of the cylinder 14, an impression of the stamping dies 20 and 21 is made cleanly and at a predetermined position on the paper stock.

The inking mechanism has been removed from the cylinder press 12, and a pair of supply spools 22 and 24 are carried rotatably on a supply spool shaft 26. The supply spool shaft 26 is connected to the chase 16 by means of a pair of arms 28 fastened to that end of the chase 16 which is closer to the cylinder 14. An elongate ribbon-like web of foil-carrying material 30 or 32 is provided on each supply spool 22 and 24, respectively, extending upwardly and passing over a supply roller 34 which extends parallel with the supply spool shaft 26. The supply roller 34 may, for example, be a tubular sleeve of a low-friction plastics material disposed rotatably on a metal rod so that the roller 34 supports the web 30 or 32 of foil-carrying material at a height slightly greater than that of the upper face of the stamping dies 20 and 21.

The foil-carrying material is well known in the art and consists, for example, of a long web of a synthetic plastic upon which a layer of a metallic or other foil is attached by a temperature-sensitive adhesive, so that application of pressure against the underside of the webs 30 and 32 by the heated dies 20 and 21 results in release of the heated portions of the foil coating and deposition of the foil material upon the paper stock.

A support pad 36 is carried on the chase 16 on the side of the heated plate 18 further from the cylinder 14 of the press 12. The support pad 36 may be of any suitable resilient material which is sufficiently compressible not to interfere with the cylinder 14. The support pad 36 should be high enough to suspend the webs 30 and 32 of foil-carrying material above the stamping dies 20 and 21. This prevents contact of the webs 30 and 32 of foil against the stamping dies 20 and 21 except during the intended impression of the stamping dies 20 and 21 against the paper stock carried on the cylinder 14 as the chase 16 moves beneath the cylinder 14 in synchronization with a sheet of stock carried on the cylinder 14.

A pair of arms 38 are attached to the chase 16 and extend parallel with the direction of movement of the chase, away from the cylinder 14, toward a foil draw mechanism 40 whose location is fixed with respect to the cylinder press 12, as by a pair of position control braces 41 located on opposite sides of the apparatus. Extending laterally between the arms 38 is a roller 42 of construction similar to that of the supply roller 34. Extending from each of the arms 38 toward the foil draw mechanism 40 is a foil-support frame or rack 44 comprising two pairs of parallel longitudinal members. Two laterally-separated first longitudinal members 46, one located adjacent each side of the cylinder press 12, are pivotably attached to the arms 38, at the location of the roller 42, as shown in FIG. 2. Two second longitudinal members 48 are pivotably attached at one end to the opposite ends of the respective ones of the first longitudinal members 46, and are also pivotably attached at their opposite ends to the foil draw mechanism 40. A plurality of transversely extending members 50, 52, 54, 56, 58, and 60, which may be bars equipped with rollers similar to the supply roller 34, extend between the ones of each pair of first and second longitudinal members 46 and 48. The transverse member 54 is located at the pivotable interconnection of the ends of the longitudinal members 46 and 48, while the transverse member 60 coincides with the pivotable point of attachment of the longitudinal members 48 with the foil draw mechanism 40. The webs 30 and 32 of foil-carrying material extend above the transverse member 50, beneath the transverse member 52, above the transverse member 54, beneath the transverse member 56, above the transverse member 58, and beneath the transverse member 60. The transverse members 50, 52, 54, 56, 58, and 60 thus support the webs 30 and 32 of foil-carrying material, maintaining substantially constant tension in them as the chase 16 moves reciprocatingly.

As the chase 16 moves on its retraction stroke toward the foil draw mechanism 40, the pairs of first and second longitudinal members 46 and 48 pivot upwardly about their respective pivotable points of attachment to the arms 38 and to the foil draw mechanism 40, which is coincident with the transverse bar member 60. The pivotably interconnected ends of the longitudinal members 46 and 48 rise, lifting the ribbons 30 and 32 of foil-carrying material during movement of the chase 16 toward the foil draw mechanism 40, and move downward, as indicated by the broken line portion of FIG. 3, as the chase 16 moves beneath the cylinder 14 during an impressing stroke, so that the length of and amount of tension in the webs 30 and 32 remains substantially constant between the supply spools 24 and 26 and the foil draw mechanism 40.

A limit switch 62 is located on the foil draw mechanism 40 in a position to sense the position of one of the second longitudinal members 48, thus the sense the positions of the foil rack 44 and of the chase 16. The limit switch 62 is preferably a magnetically actuated reed switch mounted so that it is magnetically actuated slightly before the chase 16 and cylinder 14 come together in the impression-making relationship. No draw of the foil-carrying material will occur while the limit switch 62 is actuated, but during the retraction stroke of the chase 16 from beneath the cylinder 14, the limit switch 62 will become deactuated, enabling the foil draw mechanism 40 to move the webs 30 and 32 of foil-carrying material, as will be explained more completely subsequently.

Figure 6:
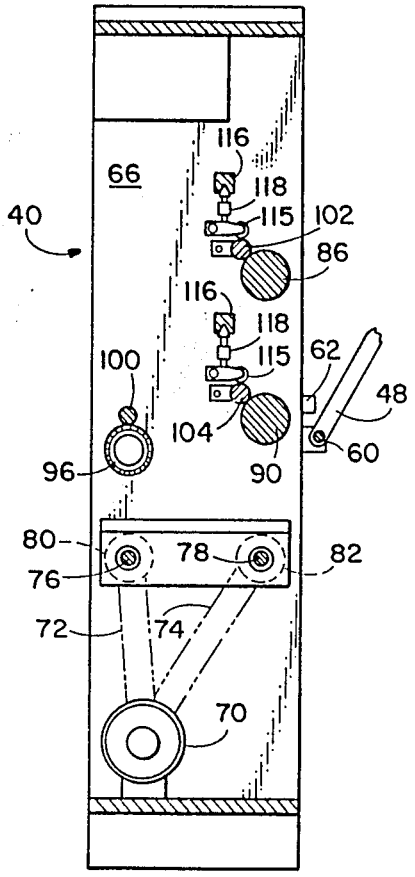
FIG. 6 is a sectional view, taken along line 6—6, of the apparatus shown in FIG. 5.
Figure 4:
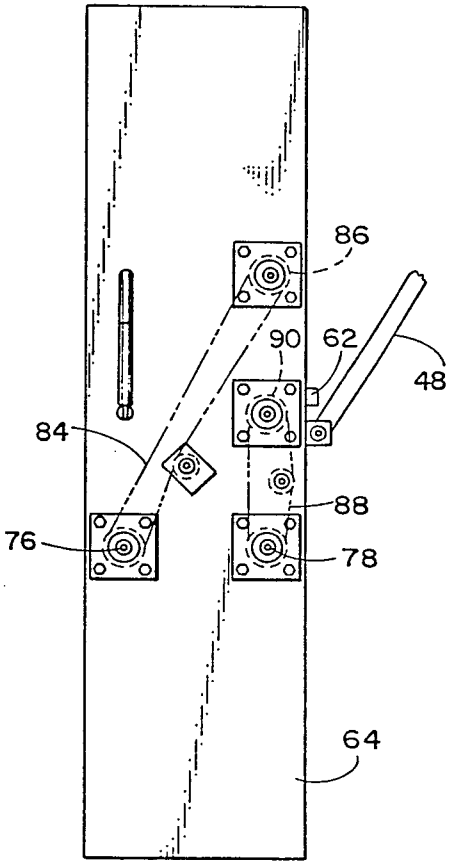
FIG. 4 is an end view of the foil-drawing mechanism of the foil-carrying apparatus of FIG. 1.
Figure 5:
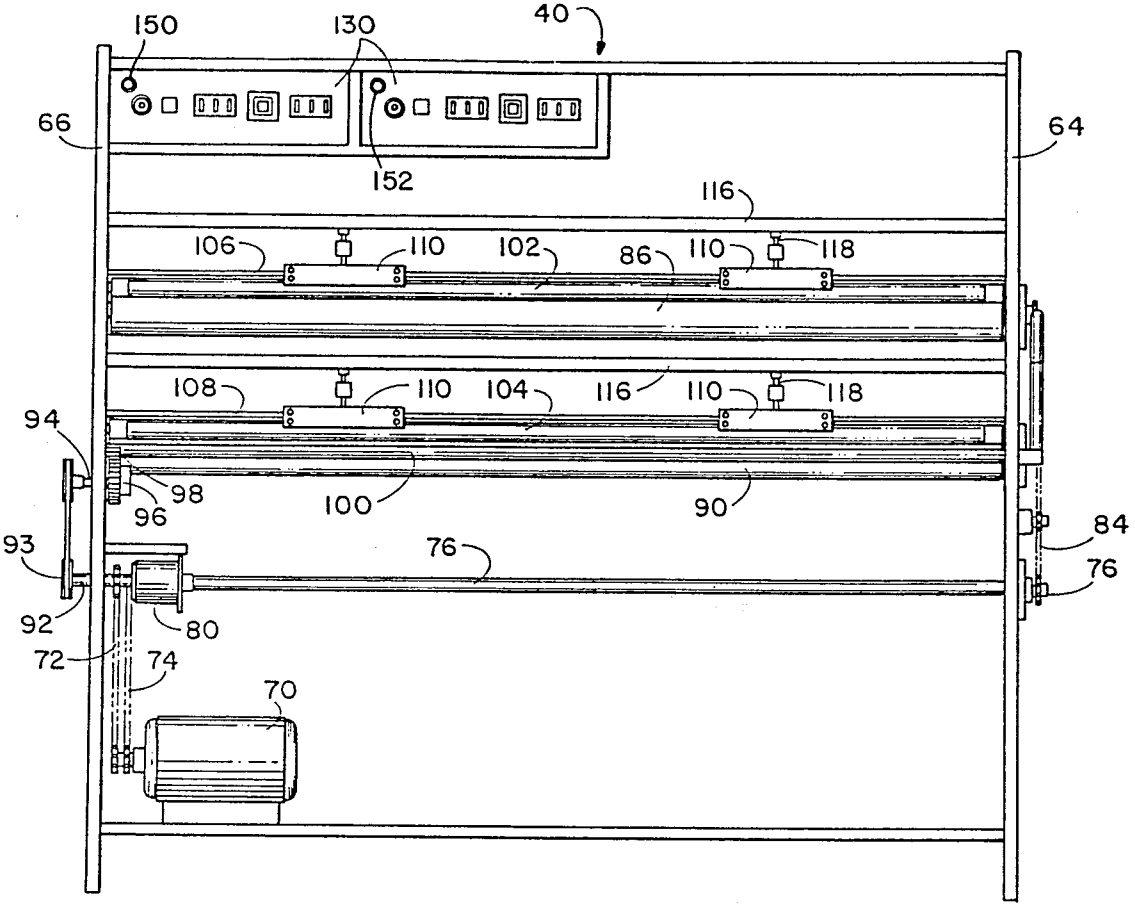
FIG. 5 is a front view of the foil-drawing apparatus shown in FIG. 4.

Referring now also to FIGS. 4–6, the foil draw mechanism 40 includes a frame having a pair of apart-spaced vertical end plates 64 and 66, which are fixedly located with respect to the cylinder press 12. A suitable motor 70, such as an electric induction motor, is connected by drive chains 72 and 74, transfer shafts 76 and 78, and electrically controlled clutches 80 and 82, so that while the motor 70 and drive chains 72 and 74 rotate continuously, the transfer shafts 76 and 78 operate only intermittently as controlled by the clutches 80 and 82.

The transfer shaft 76 is connected by a drive chain 84, with the use of conventional sprockets, to drive a draw roller 86, which is rotatably supported in bearings located on the opposite end plates 64 and 66. Similarly, a drive chain 88 extends around conventional sprockets and is connected to drive a draw roller 90.

The continuously driven portion 92 of the transfer shaft 78 extends outwardly through the end plate 66. A V-belt pulley 93 located on the continuously driven portion 92 is connected by means of a V-belt to a similar pulley on a rewind drive shaft 94 supported rotatably in bearings and extending through the end plate 66, where a drive pinion 96 is fixedly mounted on the shaft 94. The drive gear 96 is meshed with a mating gear 98 drivingly connected with a rewind spindle 100, which is used to support and rotate rewind spools fitting loosely on the rewind spindle 100, for accumulating the portions of the foil webs 30 and 32 which have been used.

The clutches 80 and 82 are preferably of a relay-controlled electrically actuated type which permits engagement for an incremental amount of time and prevents overrunning rotation of the driven shaft. For example, the CB-5 Model S incremental rotation control package manufactured by Warner Electric Brake & Clutch Company of South Beloit, Ill., is suitable. In a preferred embodiment of the present invention the clutches 80 and 82 are provided with a ratchet mechanism which permits the associated transfer shaft 76 or 78 to rotate in increments of about 16° each, depending upon the duration of the actuation of the respective clutch 80 or 82.

The draw rollers 86 and 90 extend transversely between the end plates 64 and 66, and may be of metal such as aluminum having a suitable surface configuration intended to facilitate gripping the webs 30 and 32 of foil material. Associated with the draw rollers 86 and 90 are respective pressure rollers 102 and 104 which have resilient surfaces of material such as rubber and are of a diameter smaller than that of the draw rollers 86 and 90. The pressure rollers 102 and 104 are supported for rotation parallel with and with their surfaces in contact with the surfaces of the respective draw rollers 86 and 90, so as to grip the webs 30 and 32.

Figure 7:
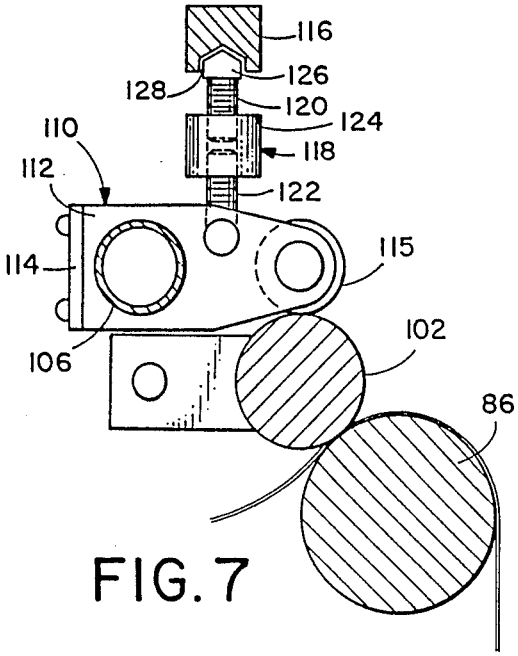
FIG. 7 is a detail view, at an enlarged scale, showing the pressure roll and backup roll arrangement of the apparatus shown in FIG. 5.

Extending transversely between the end plates 64 and 66, parallel with and spaced apart from the respective pressure rolls 102 and 104, are backup roll carrier bars 106 and 108. Located on each backup roll carrier bar are two backup roller carrier frames 110. As may be seen in FIG. 7, each backup roller carrier frame 110 includes a pair of arms 112 extending from a back member 114, and a metal roller 115 rotatably mounted with its central axis of rotation extending parallel with the draw rollers 86 and 90.

A backup roller pressure bar 116 extends transversely between the end plates 64 and 66 above each backup roller carrier frame 110, and an adjustment fixture 118 including a pair of oppositely threaded screws 120 and 122 and a thumb nut 124 exert pressure upwardly, forcing an upper end 126 into a groove 128 defined in the bottom side of each pressure bar 116. Adjustment of the thumb nut 124 extends the screws 120 and 122 apart from one another causing the upper end 126 to press into the groove 128 and thus forcing the backup roller carrier frame 110 downwardly so that the backup roll 115 presses downwardly against the respective pressure roll 102 or 104.

A draw controller 130 is provided to control electrically the operation of the clutches 80 and 82 in order to pull the webs 30 and 32 of foil-carrying material an incremental distance after each impression is made on a sheet of paper stock. The controller 130 is programmed to permit independent adjustment of either or both of the two foil advance roller sets by independently controlling the clutches 80 and 82. Since only a single transfer of foil to paper can be made from any given portion of the foil-carrying material, it is necessary to pull the webs 30 and 32 far enough so that fresh foil is positioned above each of the dies 20 and 21 for each piece of stock paper on which an impression is to be made. The draw controller 130 provides an electrical signal of appropriate duration to control operation of the clutches 80 and 82 so as to pull the webs 30 and 32 of foil material the required distance after each impression has been made on a sheet of paper stock.

It will be appreciated that where there are two dies 20 and 21 each making an impression on a separate location on the sheet of stock, with the dimension of each impression in the direction of the movement of the webs 30 and 32 being of a relatively small size compared to the distance between the dies 20 and 21, it is possible to make several closely-spaced impressions of each of the dies 20 and 21 by moving the webs 30 and 32 an impress draw distance slightly greater than the dimension of the larger of the dies 20 and 21. A fresh area of the foil material is thus obtained for each of several successive impressions of each of the dies 20 and 21. After a few such impressions, however, the portions 132 of the foil-carrying material from which impressions of the die 21 have been made would be positioned above the die 20, causing it to fail to make a complete impression on the next sheet of paper stock. The draw controller 130, for that reason, provides an engagement signal to the clutch 80 or 82 of sufficient duration to pull the web 30 or 32 of foil-carrying material a skip draw distance, for enough to move the portions 132 beyond the die 20 and provide a fresh area of the foil-carrying material in position above the die 20 for the next impression to be made.

Figure 8:
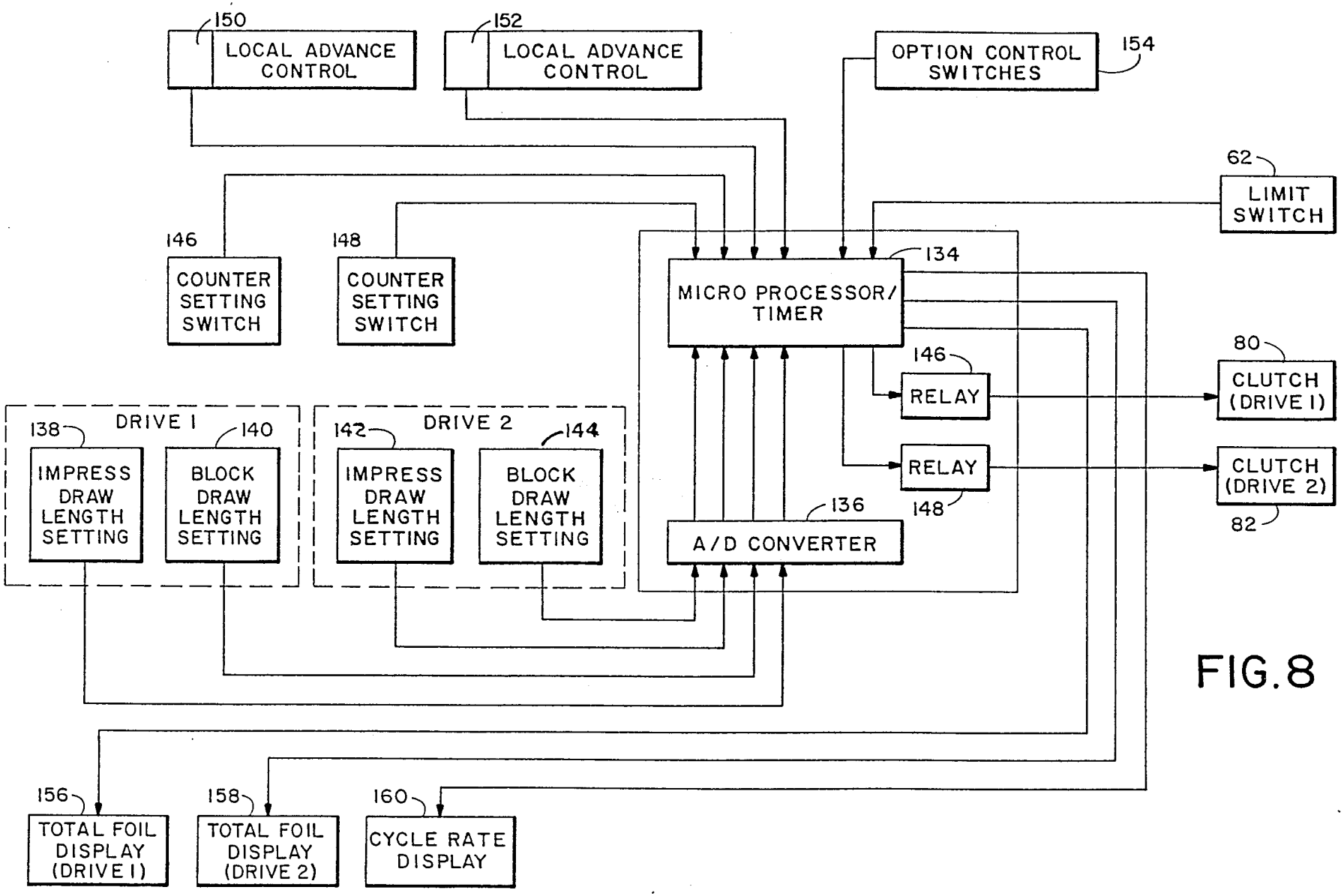
FIG. 8 is a block diagram of the controller and foil-drawing mechanism of the present invention.

A preferred embodiment of the controller 130 is shown as a block diagram in FIG. 8. Preferably, the controller 130 includes a microprocessor 134 which may be an externally programmable read-only memory (EPROM) integrated circuit device of the Intel MCS-48 family, such as an 8748 or 8749H device, or an 8035 or 8039 device equipped with 2 kilobytes of external program memory, available from Intel Corporation of Santa Clara, Calif.

An 8-bit analog-to-digital converter 136 is connected to provide an appropriate one of 256 digital values to the microprocessor 134 from each of the thumb-wheel-operated, digitally indicating potentiometers 138, 140, 142, and 144, which are used by the operator to set the impress draw and skip draw distances by which the web 30 or 32 should be drawn upon deactuation of the limit switch 62 as the chase 16 is being retracted from the impression-receiving position beneath the cylinder 14. Preferably, the digital potentiometers are capable of settings from 000 to 999. The microprocessor 134 provides a timing control signal to the appropriate one of a pair of output relays 146 and 148 which respectively control the clutches 80 and 82, so that the digital setting of the potentiometers is a direction indication of the number of inches by which the respective web 30 or 32 will be drawn. Thus a digital reading of 500 will preferably produce a draw length of 5.0 inches. Since an impression of foil to be made may be larger than 10 inches, or it may be necessary to draw the webs 30 and 32 a skip draw distance further than 10 inches after a number of successive groups of impressions at separated locations have been made, the microprocessor 134 may be programmed easily to operate the relays 146 and 148 to engage the clutches 80 and 82 for an additional length of time, for example, the time equivalent to drawing an additional ten inches of the webs 30 and 32, for a total of 10–20 inches controllable by means of the digital potentiometers 138, 140, 142, and 144. A digital input switch 149 is provided with respect to the web 30, and a digital control switch 151 is provided to control the microprocessor 134 with respect to the web 32, to enter a number of times by which the respective web 30 or 32 should be advanced by the impress draw distance determined by the setting of the respective impress draw control potentiometer 138 and 144. After the number of draws of the distance set by the respective impress draw potentiometers 138 and 142, the microprocessor 134 will cause the respective one of the relays 146 and 148 to be operated according to the setting of the skip draw control potentiometer 140 or 144 which is associated with that relay, in order to pull the respective one of the web 30 and 32 far enough to provide a fresh foil surface for both of the dies 20 and 21.

Each of the skip count control switches 149 and 151 is presettable for a digit from 0–99. The number set is the number of foil impress draws that will be performed before a single skip draw. If the counter control switches 149 and 151 are set at zero, then no skip draw will occur and the draw length will be controlled by the impress draw setting of the respective one of the potentiometers 138 or 142.

Additionally, a pair of switches 150 and 152 is provided, preferably in the form of push buttons, to provide a signal to the appropriate clutch 80 or 82 to pull the web 30 or 32 as desired by the operator of the cylinder press 12.

A set of switches 154 is provided to permit selection fo various options in a preferred embodiment of the controller. The options controlled by such switches 154 may include the use of both or only one of the drive control sections of the controller, and use of added length of the draw in connection with any or all of the four potentiometers 138, 140, 142, and 144 which control the length of draws. Another such option would be different settings of a time delay to be computed by the microprocessor 134, between the time at which the limit switch 62 is deactuated and when the draw controller 130 provides a signal to begin drawing a required distance of the webs 30 or 32. Such a delay may be desired to provide time for the foil-carrying material to free itself from the stock and the foil deposited on the stock.

In a preferred embodiment of the controller 134 digital displays 156, 158, and 160 are made available to show the total amount of foil-carrying material which has been drawn from each of the supply spools 22 and 24, and to provide an indication of the rate at which the machine is embossing sheets of stock material.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Foil application apparatus useable in connection with a printing press equipped with a heated die and apparatus for carrying successive sheets of stock, for hot die stamping of foil onto a sheet of stock so carried on the press, the foil application apparatus comprising:

(a) supply means for holding ready a supply spool of foil-carrying material in the form of a coiled web;

(b) foil draw means fixedly located with respect to said press and separate from said foil application apparatus for carrying successive sheets of stock, for periodically pulling a portion of foil-carrying material from said supply spool through a predetermined position with respect to said apparatus for carrying successive sheets of stock;

(c) draw control means for adjustably controlling the distance through which said foil draw means pulls said foil-carrying material; and (d) adjustable means included in said draw control means, for causing said foil draw means to pull said foil-carrying material a first distance a predetermined plurality of times, and to draw said foil-carying material a different second distance each time said foil draw means has drawn said foil-carrying material said first distance said predetermined plurality of times.

2. The apparatus of claim 1, including limit switch means responsive to the position of said apparatus for carrying successive sheets of stock, for initiating operation of said foil draw means at a time other than when a foil impression of said die is being made upon said stock.

* * * * *

UNITED STATES PATENT AND TRADEMARK OFFICE

CERTIFICATE OF CORRECTION

PATENT NO. : 4,744,294

DATED : May 17, 1988

INVENTOR(S) : Dirk Liepelt, deceased et al.

It is certified that error appears in the above-identified patent and that said Letters Patent is hereby corrected as shown below:

| | |
|---|---|
| Col. 2, line 1 | After "material extends" delete --material extends-- |
| Col. 4, line 66 | Change "the" (first occurrence) to --to-- |
| Col. 7, line 15 | Change "direction" to --direct-- |
| Col. 7, line 36 | Change "138 and 144" to --138 or 144-- |
| Col. 7, line 59 | Change "fo" to --of-- |
| Col. 8, line 49 | Change "foil-carying" to --foil-carrying-- |

Signed and Sealed this

Fourteenth Day of November, 1989

*Attest:*

JEFFREY M. SAMUELS

*Attesting Officer* *Acting Commissioner of Patents and Trademarks*